US009427069B1

(12) United States Patent
Carver et al.

(10) Patent No.: US 9,427,069 B1
(45) Date of Patent: Aug. 30, 2016

(54) DRILL HOLSTER

(71) Applicant: Atlas 46, LLC, Fenton, MO (US)

(72) Inventors: John W. Carver, Dittmer, MO (US); Keith Ericson, Barnhart, MO (US)

(73) Assignee: ATLAS 46, LLC, Fenton, MO (US)

( * ) Notice: Subject to any disclaimer, the term of this patent is extended or adjusted under 35 U.S.C. 154(b) by 0 days.

(21) Appl. No.: 14/746,197

(22) Filed: Jun. 22, 2015

(51) Int. Cl.
*A45F 5/00* (2006.01)
*A45F 5/02* (2006.01)

(52) U.S. Cl.
CPC ..... *A45F 5/00* (2013.01); *A45F 5/021* (2013.01); *A45F 2005/008* (2013.01); *A45F 2200/0575* (2013.01)

(58) Field of Classification Search
CPC ..... A45F 5/021; A45F 2200/0575; Y10S 224/904
USPC ..... 224/904, 242, 246, 250, 675, 232, 234
See application file for complete search history.

(56) References Cited

U.S. PATENT DOCUMENTS 2,049,293 A * 7/1936 Fink ..... A45F 5/021 224/675
2,626,092 A * 1/1953 Rose ..... A45F 5/14 224/232
2,643,803 A 6/1953 Bates
2,650,008 A * 8/1953 Morseth ..... F41B 13/04 224/232
2,910,804 A * 11/1959 White ..... F41C 33/0263 2/300
3,565,303 A * 2/1971 Kippen ..... A45F 5/021 224/675
3,997,092 A 12/1976 Pogwizd
4,720,030 A * 1/1988 Petrovich ..... B26B 11/005 224/232
4,779,777 A * 10/1988 Johnson ..... A45F 5/02 224/250
4,907,729 A * 3/1990 Hess, III ..... A45C 1/04 224/240
4,917,281 A * 4/1990 Ostermiller ..... A45F 5/02 224/240
D333,215 S * 2/1993 Brown ..... D3/228
5,307,967 A 5/1994 Seals
5,388,740 A * 2/1995 Garland ..... A45F 5/02 224/242
5,450,993 A * 9/1995 Guerrero ..... H04B 1/3888 206/305
5,497,921 A 3/1996 Dancyger
5,586,701 A * 12/1996 Kim ..... F41C 33/0227 224/236
D409,831 S * 5/1999 Lyles ..... D3/228

(Continued)

FOREIGN PATENT DOCUMENTS

CA 1282381 4/1991
CA 2656914 9/2009

*Primary Examiner* — Justin Larson
(74) *Attorney, Agent, or Firm* — Husch Blackwell LLP

(57) ABSTRACT

A drill holster including a base member, a sheath coupled to the base member forming a pocket with the base member for receiving a portable drill, and a securing mechanism for retaining a drill in the pocket, the securing mechanism being coupled to the exterior surface of the sheath and including an elastomeric member forming a loop, the elastomeric member being stretchable from a neutral, at rest, position where the elastomeric member is positioned and located below the top portion of the pocket to a secured position engaging at least a portion of a drill positioned within the pocket, and wherein the perimeter of the elastomeric member when in its secured position is greater than the perimeter of such member when in its neutral position.

15 Claims, 5 Drawing Sheets

(56) References Cited

U.S. PATENT DOCUMENTS

| | | | | | |
|---|---|---|---|---|---|
| 5,915,606 | A | | 6/1999 | Jensen | |
| D414,337 | S | * | 9/1999 | Hubert | D3/222 |
| 5,984,046 | A | * | 11/1999 | Urso, Jr. | A45F 5/14 182/129 |
| 6,016,944 | A | | 1/2000 | Girbert | |
| 6,065,658 | A | | 5/2000 | Hashimoto | |
| 6,085,952 | A | * | 7/2000 | Garland | A45F 5/021 224/242 |
| 6,109,496 | A | * | 8/2000 | Andrew | A45F 3/00 224/223 |
| 6,131,780 | A | * | 10/2000 | Becker | A45F 3/04 224/148.6 |
| 6,155,471 | A | | 12/2000 | Lichtenberger | |
| 6,315,179 | B1 | | 11/2001 | Hillis | |
| D455,901 | S | * | 4/2002 | Snider | D3/228 |
| 6,364,187 | B1 | * | 4/2002 | Castellano | A45F 5/02 224/236 |
| 6,412,674 | B1 | * | 7/2002 | Lipke | A45C 7/00 224/235 |
| 6,561,402 | B2 | | 5/2003 | Holland | |
| 6,719,178 | B1 | | 4/2004 | Taylor | |
| 6,892,914 | B2 | | 5/2005 | Girbert | |
| 6,971,562 | B2 | * | 12/2005 | Willows | A45F 5/00 224/148.4 |
| 7,163,132 | B2 | | 1/2007 | Rundberg | |
| 7,520,412 | B2 | * | 4/2009 | Willows | A45F 3/14 224/148.4 |
| 8,240,532 | B2 | * | 8/2012 | Cragg | A45F 3/08 224/648 |
| 2002/0108980 | A1 | | 8/2002 | Kahn | |
| 2006/0266782 | A1 | * | 11/2006 | Godshaw | A45F 5/02 224/674 |
| 2007/0056999 | A1 | * | 3/2007 | Kahn | A45F 5/02 224/250 |
| 2008/0073393 | A1 | * | 3/2008 | Soderquist | F41C 33/0227 224/243 |
| 2008/0251552 | A1 | * | 10/2008 | Bell | A45F 3/16 224/250 |
| 2009/0242598 | A1 | | 10/2009 | Dormaar | |
| 2015/0233672 | A1 | * | 8/2015 | Visalli | F41C 33/0227 224/246 |

* cited by examiner

DRILL HOLSTER

FIELD OF THE INVENTION

The present invention relates to a drill holster that can be either permanently or removably attached to a garment to allow a user to attach and carry a tool, such as a corded or portable cordless drill, securely on their person.

BACKGROUND OF THE INVENTION

It is well recognized that many tradespersons utilize portable cordless drills on a regular basis as they perform their work. It is also well recognized that while the tradesperson may utilize a cordless drill often while performing his/her work, they also need both hands free much of the time so they cannot carry the drill in their hands at all times. Thus, there is a need in the art for a drill holster which allows a user to carry a portable cordless drill on his/her person without having to carry the drill by hand.

To date, such holsters have been made and offered to tradespersons. U.S. Pat. No. 6,561,402 describes a drill holster which secures the drill with a strap which is attached to the inside backing portion of the holster and extends over the end or handle of the drill and attaches to the outside of the holster pocket. In addition, U.S. Pat. No. 6,065,658 also describes a drill holster where a "wrap-around strap" is attached to the side of the holster proximate the body of the user and then the strap "wraps around" the drill to be removably attached to the outward facing side of the holster. Similarly, U.S. Pat. No. 6,892,914 also discloses a securing strap that is attached to the back side of the holster and extending over the end of the drill and is then attached to the outer surface of the front side of the holster to secure the drill in the holster.

It has been observed that the use of these "wrap-around" straps presents a few substantial shortcomings. One is that when the drill is located in the holster, the strap is free to "flop" around if not attached at its second end, and, therefore, the location of the unsecured strap is not always the same or predictable. This condition creates a hazard or obstruction when one is attempting to place a drill within the holster pocket as the strap can end up lying inside the pocket of the drill holster thereby obstructing the pocket during insertion of the drill. This then will require a user to use both hands to both (1) maintain a hold on the drill and (2) to locate, grab and remove the strap from the holster pocket so that the drill can be inserted therein. In addition, since the strap is attached to the side of the holster, it may be difficult to reach, find, and grab the strap with the same hand that is holding the drill for insertion into the pocket. Thus, this arrangement also requires using a hand other than the hand which holds and inserts the drill into the drill holster.

It is clearly evident that a need exists for a drill holster that provides a securing mechanism that does not fall into the pocket of the holster, provides a consistent and predictable location for reaching and grabbing at all times, and is easy to engage and disengage with one hand.

Further, existing drill holsters present another shortcoming with respect to being a universal drill holster capable of accommodating drills of various sizes and shapes including having differing chuck lengths and over-all lengths. For example, the drill holsters presented in U.S. Pat. No. 6,561,402 and U.S. Pat. No. 6,065,658 include pockets or pouches that include a closed end which severely limits accommodating drills of various lengths or different chuck lengths. In addition, drill holsters like that of U.S. Pat. No. 6,892,914 include open ends, but the drill-chuck extends freely out of the end of the pocket and may poke or come directly in contact with the user's body while arranging the drill in the holster. Thus, there is also a need in the art for a drill holster that accommodates drills having different chuck lengths while preventing an extending chuck from contacting a user's body causing discomfort or injury.

It is an object of the present invention to provide a drill holster that provides a more consistent, predictable and easier securing mechanism allowing a one-handed insertion and securing of the drill in the drill holster.

It is another object of the present invention to provide a drill holster that accommodates drills having different chuck lengths while preventing an extending chuck from contacting a user's body.

BRIEF SUMMARY OF THE INVENTION

The present invention relates to a drill holster for holding, retaining and transporting a corded or portable cordless drill. The drill holster includes a base member, a sheath attached to the base member, and a securing mechanism for securing the drill in the drill holster. The base member may include a reinforcing member disposed on an exterior surface of the base member. The sheath is coupled to the base member to define a pocket for receiving a drill and includes a top portion, a bottom portion, a first side, a second side, and an exterior surface. The pocket includes an open top and preferably an open bottom. The reinforcing member of the base member may be disposed adjacent to the open bottom of the pocket.

The securing mechanism includes an elastomeric member forming a securing loop, wherein the securing loop is attached to an exterior surface of the sheath proximate the open top portion of the pocket at a number of attachment points. The attachment points may be a loop or ring, thereby allowing the securing loop to freely slide relative to one or more attachment points. The securing loop may also be formed by having the opposite end portions of the elastomeric member tied into a knot, wherein the knot is located proximate the first and second opposite end portions thereof. The drill holster may also include a spring-loaded cord lock for at least partially defining the perimeter of the securing loop and for allowing the perimeter of the securing loop to be selectively adjusted.

The securing loop of the present drill holster is movable between a neutral, at rest, relaxed position where it is positioned and located below the open top portion of the pocket and a stretched secured position securely holding a drill in the drill pocket. When in its secured position, the perimeter of the securing loop is greater than the perimeter of the securing loop when in its neutral, at rest, position. When stretched, the securing loop will engage a butt portion or handle portion of the drill after the drill is inserted into the pocket. The elastic contraction of the securing loop after it is stretched and engaged with the drill retains the drill in the drill holster.

Other aspects and advantages of the present invention will be apparent from the following detailed description of the preferred embodiments and the accompanying drawing figures.

Figure 1:
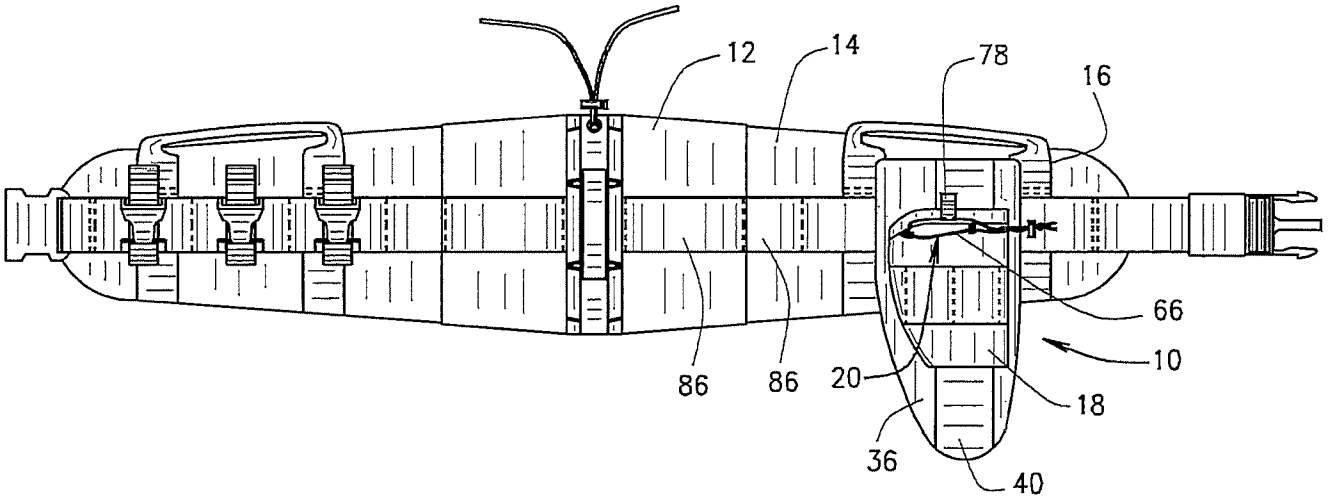
FIG. 1 is a side elevational view of one embodiment of the present drill holster constructed in accordance with the teachings of the present invention and attached to a garment, namely a utility belt.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The present invention will now be described with reference to the drawing figures in which like reference numerals refer to like parts throughout. For purposes of clarity in illustrating the characteristics of the present invention, proportional relationships of the elements have not necessarily been maintained in the drawing figures.

Referring to the drawings more particularly by reference numbers wherein like numerals refer to like parts, FIG. 1 illustrates one embodiment of the present drill holster 10 that can be either permanently or removably attached to a garment 12. In the embodiment shown in FIG. 1, garment 12 is a belt 14. Alternatively, garment 12 may be any other piece of clothing or equipment including, but not limited to, a vest, a jacket, pants, a backpack, a tool belt, a harness, or any other application where a user desires to include the storage and easy access to a portable drill for any purpose.

Figure 4:
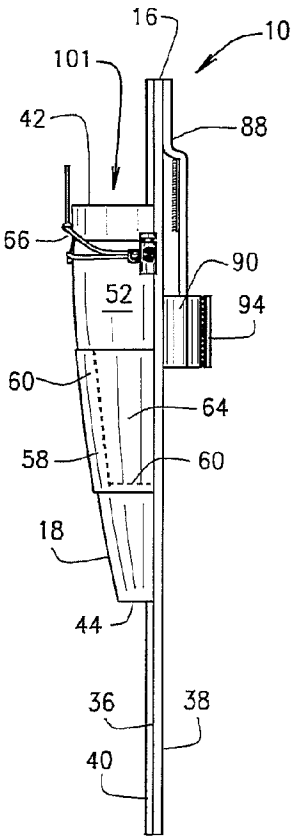
FIG. 4 is a right side elevational view of the drill holster of FIG. 2.
Figure 3:
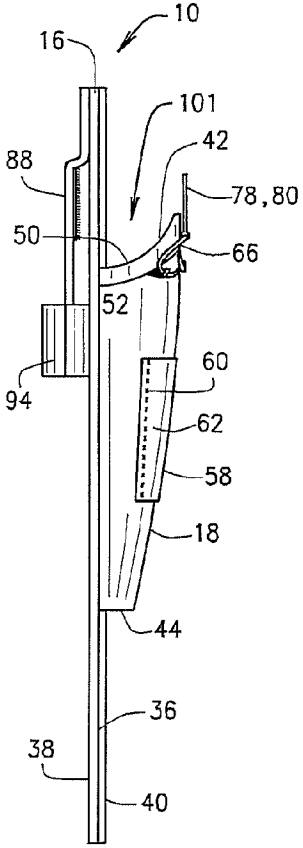
FIG. 3 is a left side elevational view of the drill holster of FIG. 2.
Figure 2:
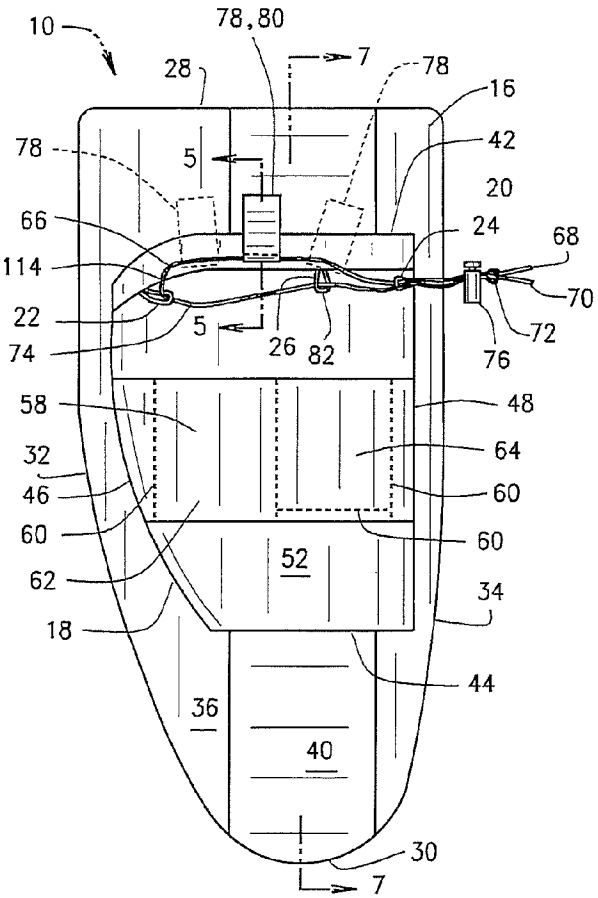
FIG. 2 is a front elevational view of the drill holster of FIG. 1 constructed in accordance with the teachings of the present invention.

Referring to FIG. 2, drill holster 10 includes a base member 16, a sheath 18 attached to base member 16 so as to form a pocket 101, and a securing mechanism 20 for securing a drill in the drill holster 10. Pocket 101 is formed by and between base member 16 and sheath 18. Securing mechanism 20 may be coupled to sheath 18 at a first attachment point 22, a second attachment point 24, and a third attachment point 26. Any number of attachment points may be used as will be hereinafter further explained depending upon the size of the holster. Base member 16 may include a top portion 28, a bottom portion 30, a first side portion 32, a second side portion 34, an exterior surface 36, and an interior surface 38 (shown on FIGS. 3 and 4). In addition, base member 16 may also include a reinforcing strip member 40 disposed on the exterior surface 36 extending substantially between top and bottom portions 28 and 30 and disposed between first and second side portions 32 and 34 as best illustrated in FIGS. 2-4. The reinforcing strip member 40 may be a strip of webbing, a layer of fabric, a flexible or rigid polymer layer, or any other known reinforcing material or member.

FIG. 2 also illustrates the configuration of sheath 18 relative to base member 16 so as to form pocket 101. Sheath 18 has a top portion 42, a bottom portion 44, a first side portion 46 and a second side portion 48 wherein the first side portion 46 may include a notch or recess portion 50 (see FIG. 3) proximate top portion 42 for receiving a handle associated with a drill. The top 42, bottom 44, first and second sides 46 and 48 of sheath 18, and base member 16, define a pocket 101 for receiving a drill. Bottom portion 44 of pocket 101 may be open or closed. Sheath 18 also includes an exterior surface 52 and an interior surface 54 (shown in FIG. 7). Sheath 18 may be coupled to base member 16 along the entirety or substantial entirety of sides 46 and 48. Alternatively, sheath 18 may include mechanical fasteners (not shown) which couple sheath 18 to base member 16 at the corners and/or along the sides 46 and 48. Mechanical fasteners may be rivets or other known mechanical fasteners used in the textile/clothing industry.

Sheath 18 may also include a webbing strip 58 extending in a direction substantially perpendicular to both first and second side portions 46 and 48. Webbing strip 58 may be attached to sheath 18 with stitching 60 or any other suitable attachment means. Stitching 60 may be disposed to define one or more open loops 62 that may be used to attach or hang other drill/tool accessories such as longer drill bits, pencils, fasteners and so forth. In addition, stitching 60 may also be disposed on three sides to define one or more pockets 64, wherein each pocket 64 may be used to store commonly used items for drilling such as smaller drill bits, screws, fasteners or any other item. Any number of open loops 62 and pockets 64 can be formed by web strip 58 depending upon the size of the overall holster 10 and sheath 18.

As best shown in FIG. 2, drill securing mechanism 20 includes an elastomeric member or cord 66 having a first end 68 and a second end 70, wherein the elastomeric member 66 may be tied into a knot 72 or otherwise joined together proximate its first and second end portions 68 and 70 to form a closed securing loop 74. Securing mechanism 20 may further include a spring-loaded cord lock 76 disposed on the securing loop 74 interior of knot 72 so that the perimeter of securing loop 74 may be expanded or reduced by moving cord lock 76 to expand or constrict the loop. The ability to selectively adjust the perimeter of securing loop 74 is beneficial as it provides a user with the ability to adapt the securing mechanism 20 to secure a wide variety of differently sized drills in holster 10 regardless of the size and shape of the drill, particularly the handle and butt portion. Elastomeric member 66 may be a bungee cord, a shock cord, a rubber member, a latex strip, rubber/latex tubing, or any other elastic member.

In one embodiment, the perimeter of securing loop 74, in its relaxed neutral or unsecured state, may be around two times the distance between first attachment point 22 and second attachment point 24. However, the perimeter of securing loop 74 may also be less than two times the distance between first and second attachment points 22 and 24 thereby resulting in securing loop 74 being in a stretched and tensioned state at all times. Securing loop 74 may also be more than two times the distance between first and second attachment points 22 and 24 resulting in a securing loop 74 having some additional slack in its relaxed or unsecured state 114. Cord lock 76 allows a user to control the perimeter of securing loop 74 in its relaxed state by moving cord lock 76 towards or away from second attachment point 24. This adjustment capability allows a user to adjust the perimeter of securing loop 74 to accommodate different size drills.

Figure 5:
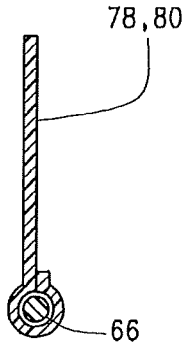
FIG. 5 is a cross-sectional view of one embodiment of the gripping element associated with the drill holster of FIG. 2 taken along the line 5-5 of FIG. 2.

Securing mechanism 20 may also include a slidable repositionable gripping element 78 disposed along the perimeter of securing loop 74 that provides sliding adjustability of its location. As shown in FIGS. 2 and 5, gripping element 78 may be a simple pull-tab 80 which is wrapped around elastomeric member 66 so that it is slidable thereon between first and second attachment points 22 and 24. Other embodiments may include gripping element 78 being a T-shaped handle, a ring, or any other structure that can be both easily grabbed by a user and slidably coupled to elastomeric member 66. In another embodiment, gripping element 78 may be fixedly attached to the elastomeric member 66 and not provide any sliding adjustability of location.

As best shown in FIG. 2, securing loop 74 may be attached to exterior surface 52 of sheath 18 at first attachment point 22, wherein first attachment point 22 is disposed proximate first side portion 46 and top portion 42 of sheath 18 or pocket 101. Securing loop 74 may also be attached to exterior surface 52 of sheath 18 at second attachment point 24, wherein second attachment point 24 is disposed proximate second side portion 46 and top 42 portion of sheath 18 or pocket 101. Securing loop 74 may also be attached to exterior surface 52 of sheath 18 at a third attachment point 26 which is disposed on sheath 18 proximate top portion 42 and between first and second side portions 46 and 48. As shown in FIG. 2, attachment points 22, 24 and 26 may be a loop or ring 82 that allows the elastomeric member 66 to slide along its length relative to the respective attachment points 22, 24 and 26. In still another embodiment, attachment points 22, 24 and 26 may be a rigid and fixed connection point. When a fixed connection point is used, securing mechanism 20 may simply be a length of an elastic member having each end respectively fixedly attached to sheath 18 at attachment points 22 and 24.

Figure 6:
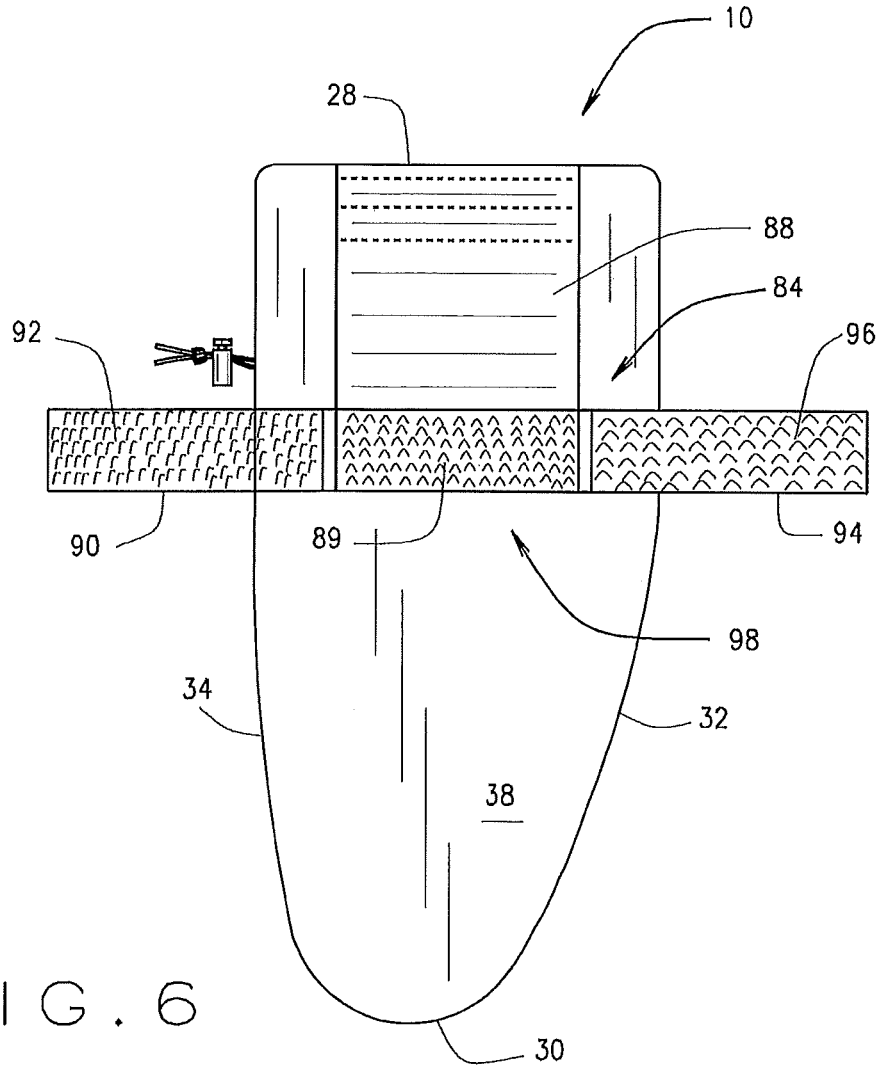
FIG. 6 is a rear elevational view of the drill holster of FIG. 2 illustrating one embodiment of an attachment system that may be used to attach the present drill holster to a garment.
Figure 7:
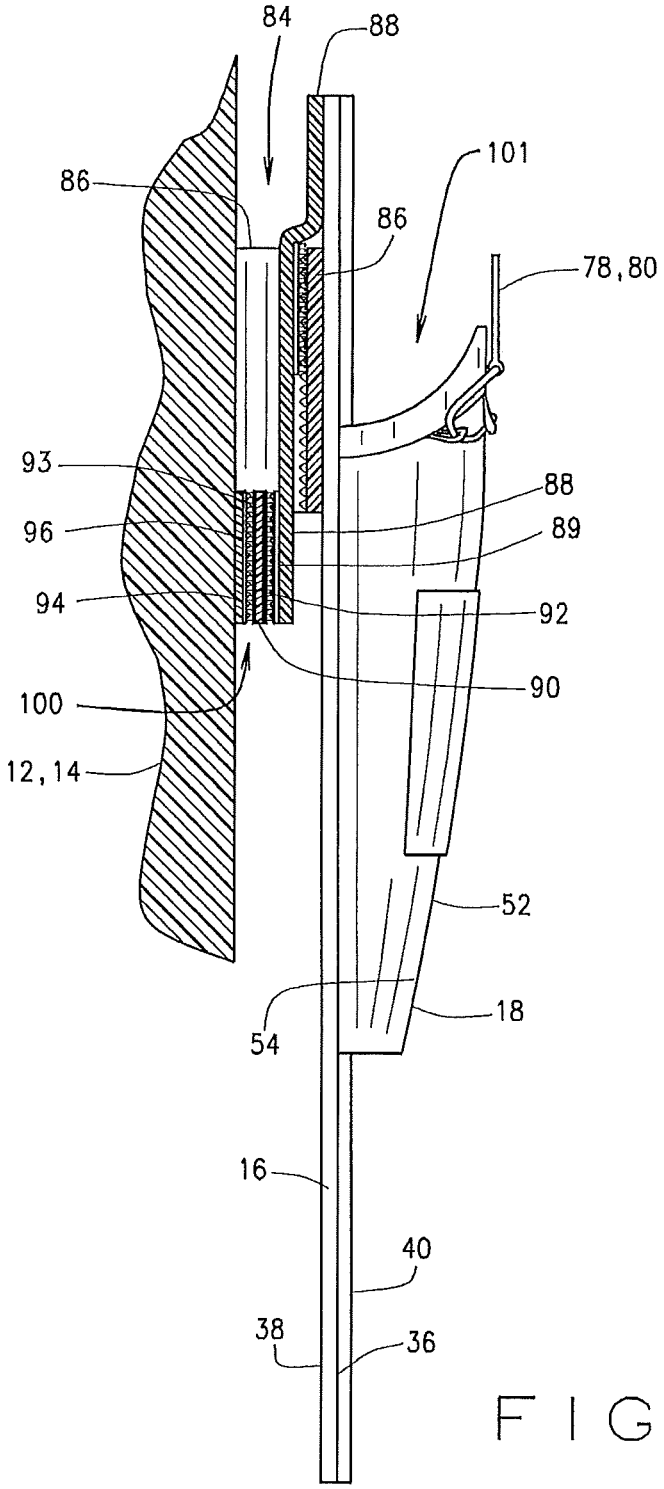
FIG. 7 is a cross-sectional view of the drill holster of FIG. 2 taken along the line 7-7 of FIG. 2 showing elements of the present drill holster and the attachment system of FIG. 6.

FIGS. 6 and 7 illustrate the use of one attachment system 84 that may be used to attach the present holster 10 to a garment or belt 12. In the embodiment shown in FIGS. 6 and 7, holster 10 is attached to a loop 86 of garment 12 (belt 14) using the integrated modular attachment system described in Applicant's co-pending U.S. patent application Ser. No. 14/745,719, the entire teachings of which are hereby incorporated herein by reference. As shown in FIG. 6, holster 10 may include some components of attachment system 84 (shown also on FIG. 7). In FIG. 6, holster 10 includes a foldable flap 88 coupled to the interior surface 38 of base member 16, foldable flap 88 being shown in its folded down position. Foldable flap 88 has a first securing mechanism 89 disposed thereon which is visible when the foldable flap 88 is in its down position as shown. First securing mechanism 89 may be the loop portion of a hook and loop fastener. In addition, drill holster 10 may further include a first wing member 90 coupled to interior surface 58 of base member 16 proximate second side position 34, first wing member 90 including a second securing mechanism 92 disposed on one side thereof and a third securing mechanism 93 (see FIG. 7) disposed on its opposite side. Second and third securing mechanisms 92 and 93 may be the hook portion of a hook and loop fastening system. Holster 10 may also include a second wing member 94 coupled to interior surface 58 of base member 16 proximate first side portion 32. Second wing member 94 includes a fourth securing mechanism 96 disposed on one side thereof, wherein fourth securing mechanism 96 may be the loop portion of a hook and loop fastening system. FIG. 6 illustrates attachment system 84 with wing members 90 and 94 in their open configuration 98. When foldable flap 88 is in its down position and first and second wing members 90 and 94 are in their open position, first, second, third and fourth securing mechanisms 89, 92, 93 and 96 are in substantial alignment with each other.

As best shown in FIG. 7, attachment mechanism 84 is illustrated with wing members 90 and 94 in a secured or closed configuration 100. Secured configuration 100 involves inserting foldable flap 88 through loop 86 of belt 14 and thereafter folding over first wing member 90 so that second securing mechanism 92 on one side of first wing member 90 engages first securing mechanism 89 of foldable flap 88. Second wing member 94 is then folded over to overlap first wing member 90 so that fourth securing mechanism 96 of second wing member 94 engages third securing mechanism 93 of first wing member 90. In the secured configuration 100, the present holster 10 is securely and removably attached to belt 14. Attachment system 84 is described in greater detail in Applicant's pending U.S. patent application Ser. No. 14/745,719 and all such disclosures and embodiments are incorporated herein by reference.

Alternatively, a person of skill in the art will appreciate that attachment system 84 may be any known attachment mechanism or system known in the art. Further, it will be appreciated by a person of skill in the art that holster 10 can likewise be fixedly attached to any garment 12 and whether the present holster 10 is removably or fixedly attached to a garment 12, such structure is within the scope of the present invention.

FIG. 7 also more clearly illustrates the pocket 101 defined by interior surface 54 of sheath 18 and exterior surface 36 of base member 16. Pocket 101 can be sized and shaped to receive any known portable drill.

Figure 9:
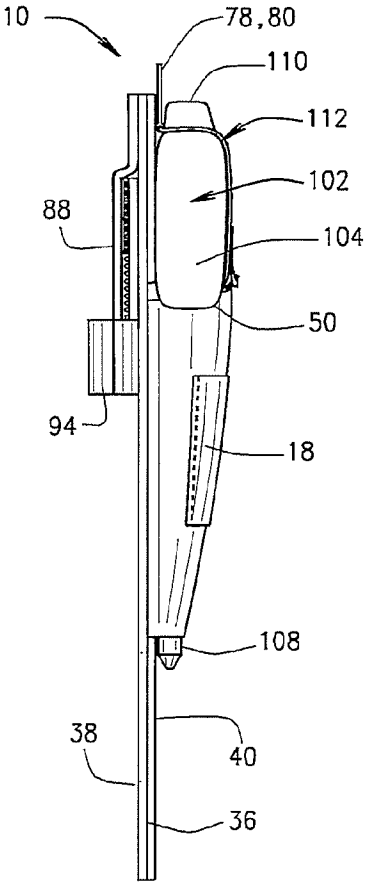
FIG. 9 is a left side elevational view of the drill holster of FIG. 8 showing a cordless drill in a secured position within the holster.
Figure 8:
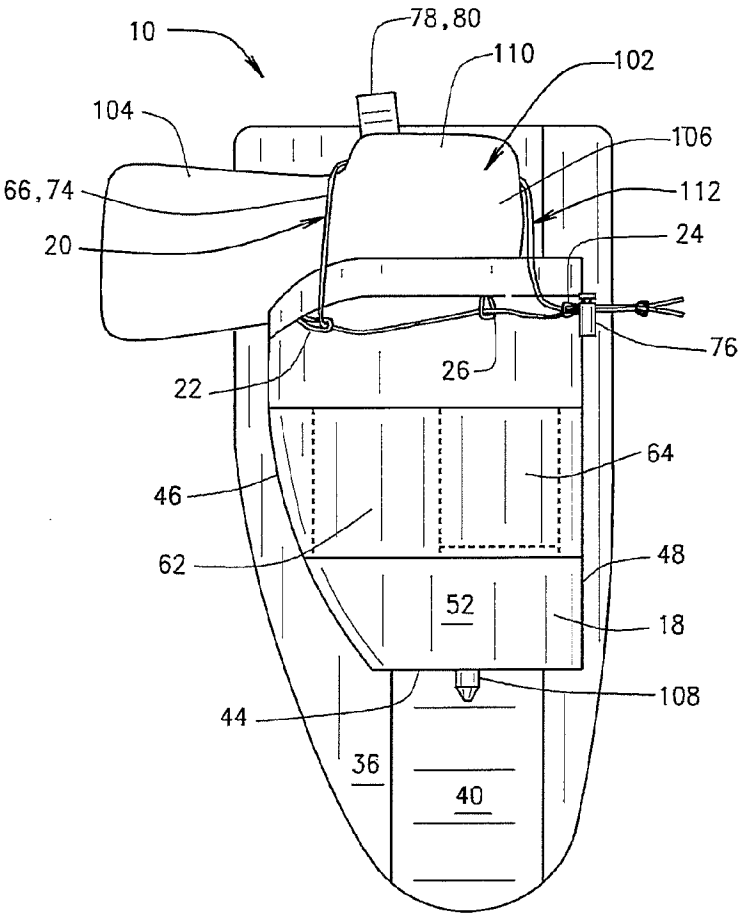
FIG. 8 is a front elevational view of the drill holster of FIG. 2 showing a cordless drill in a secured position within the holster.

Now turning to FIGS. 8 and 9, drill holster 10 is shown in use, wherein a typical portable drill 102 is received in drill holster 10. A body 106 of drill 102 will be received into pocket 101 (see FIG. 7) through its open top portion and a handle 104 of drill 102 will generally extend in a direction somewhat perpendicular to that of drill body 106 as best illustrated in FIG. 8. It is also recognized and anticipated that the angular orientation of the drill handle 104 to drill body 106 is not critical and will be governed by the make, model, and purpose of the drill. Drill 102 may be any portable drill that is commercially available. As can be further appreciated by a person of skill in the art, recess 50 is generally shaped so as to accommodate the handle 104 of drill 102 and handle 104 may be received into a recess/notch 50 disposed on the first side portion 46 of sheath 18 as best shown in FIG. 3. A chuck member 108 of drill 102 may also extend out of an open bottom 44 of pocket 101. As shown, reinforcing strip 40 may be disposed adjacent to open bottom portion 44 of pocket 101 so that chuck member 108 will contact reinforcing strip 40 if a chuck member such as chuck member 108 is left engaged with drill 102.

Drill 102 is secured in drill holster 10 by moving securing mechanism 20 to its secured position 112. As best shown in FIG. 9, the secured position 112 of securing mechanism 20 includes gripping element 78 disposed proximate exterior surface 36 of base member 18. A portion of securing loop 74 of stretched elastomeric member 66 is positioned up and over a butt end 110 of drill 102 so as to engage drill 102 proximate the location where handle 104 meets body 106

(see FIG. 8). Securing loop 74 is stretched and enlarged in the secured position 112 when compared to its neutral or unsecured position 114 (see FIG. 2). Securing element 20 is moved from its neutral, at rest, position 114 (FIG. 2) to its secured position 112 by grabbing gripping element 78 and pulling it upward so that elastomeric member 66 stretches from its neutral position 114 (FIG. 2) to increase the perimeter of securing loop 74, thereby allowing a portion of the elastomeric member 66 proximate gripping element 78 to be pulled upward and over butt end 110 of body 106 of drill 102 by pulling gripping element 78 upward and away from the open top 42 and toward exterior face 36 of base member 16. When the gripping element 78 is released, the elastomeric member 66 inherently contracts toward its neutral position to engage a portion of drill 102 proximate the location where handle 104 meets butt end 110 of body 106 thereby applying an elastic retention force on the drill 102 that acts to pull the drill 102 into sheath 18 and pocket 101 thereby opposing any force acting to remove the drill 102 from the pocket 101. The stretching of elastomeric member 66 generally occurs after the elastomeric member 66 slides relative to attachment points 22, 24, and/or 26 and spring-loaded cord lock 76 engages second attachment point 24 as shown in FIG. 8, or upon the elastomeric member 66 otherwise engaging at least first and second attachment points 22 and 24. Securing mechanism 20 may also be moved into its secured position 112 simply by directly grabbing and moving elastomeric element 66 in a similar manner.

As described above and shown in FIGS. 2 and 8, one embodiment of the present drill holster 10 includes the securing mechanism 20 connected to exterior surface 52 of sheath 18 near the open top portion of pocket 101. In addition, since mechanism 20 is elastomeric member 66 forming securing loop 74, when in its neutral position 114, securing loop 74 extends across sheath 18 from a first side portion 46 to a second side portion 48 near the top portion of pocket 101 as best shown in FIG. 2. Further, elastomeric member 66 is secured by first, second and third attachment points 22, 24 and/or 26, wherein each attachment point 22, 24 and/or 26 is a loop or ring member 82 allowing the elastomeric member 66 to move freely through loop or ring member 82. This embodiment is particularly advantageous as it allows elastomeric member 66 to stretch along substantially the entire perimeter length of securing loop 74. This configuration provides a number of advantages not realized in the art, particularly, allowing the use of a securing loop 74 that has a smaller neutral length or perimeter when in its neutral, at rest, position as shown in FIG. 2, which equates to a smaller footprint of securing mechanism 20 on exterior surface 52 of sheath 18 when securing loop 74 is in its neutral position 114. Thus, the described construction reduces the tendency of securing mechanism 20 to flop around and obstruct pocket 101 when not in its secured position 112.

Further, the described configuration of stretching the entire securing loop 74 generates a larger constriction force that is applied to retain the drill in the present holster as shown in FIG. 8. Moreover, positioning securing mechanism 20 on the exterior surface of sheath 18 proximate top portion 42 of sheath 18 and pocket 101 eliminates the securing mechanism 20 falling into pocket 101 between interior surface 54 of sheath 18 and exterior surface 36 of base member 16 (see FIG. 7) where it would interfere with inserting drill 102 into pocket 101.

Another advantage of securing mechanism 20 configured as described herein is that elastomeric member 66 is positioned on exterior surface 52 of sheath 18 proximate open end 42 and is generally disposed in a horizontal orientation in its neutral, at rest, position 114 as shown in FIG. 2. This positioning allows a user to easily insert drill 102 into pocket 101 without interference and thereafter engage securing mechanism 20, all while using only one hand. This arrangement allows both elastomeric member 66 and gripping element 78 to be easily found by feel and with one hand as these elements of securing mechanism 20 are positioned on the exterior surface 52 of sheath 18 for easily alternating between secured position 112 (FIG. 8) and neutral position 114 (FIG. 2).

After the drill 102 has been secured in drill holster 10, it may be removed simply by grabbing the gripping element 78 or the elastomeric member 66, pulling the gripping element 78 or elastomeric member upward away from sheath top 42 and over drill 102 toward exterior surface 52 of sheath 18. The elastomeric member 66 will then contract to its neutral, at rest, position 114 substantially keeping the securing mechanism 20 from flopping around when not engaged. Drill 102 can then simply be removed from the pocket 101 by grabbing drill handle 104 and pulling drill body 106 out of pocket 101.

It is also recognized that the elastomeric member 66 is stretchable from its neutral, at rest, relaxed position 114 (FIG. 2) where the elastomeric member 66 is positioned and located below the top portion of pocket 101 to its secured position engaging at least a portion of a drill located within pocket 101 as best illustrated in FIGS. 8 and 9. In addition, it is recognized that the perimeter or length of the elastomeric member 66 or securing loop 74 is greater when in its secured position 114 as compared to the perimeter of the elastomeric member 66 or securing loop 74 when in its neutral, at rest, position 112. It is also recognized and anticipated that the base member 16, the sheath 18 and the pocket 101 can be sized and shaped to accommodate any size of portable drill. In addition, the elastomeric member 66 can be of any length and the cord lock 66 enables a user to selectively adjust the size of securing loop 74 to accommodate the size of the particular portable drill being housed within pocket 101. Still further, it is recognized and anticipated that the size and shape of other components associated with the present holster 10 including attachment points 22, 24 and 26 as well as gripping member 78 and reinforcing strip 40 can likewise take on a wide variety of different sizes and shapes depending upon the particular application associated with the present holster. It is also recognized and anticipated that the present holster 10 can likewise accommodate other tools other than a portable drill. Other arrangements and combination of the various elements and components of the present holster 10 are likewise envisioned and anticipated.

Thus, there has been shown and described several embodiments of a novel drill holster. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications, which do not depart from the spirit and scope of the invention, are deemed to be covered by the invention which is limited only by the claims which follow.

The invention claimed is:

1. A drill holster comprising:

a base member;

a sheath coupled to said base member, said sheath forming a pocket in conjunction with said base member for receiving a drill, said pocket having a top and a bottom portion;

a securing mechanism for retaining a drill in said pocket, said securing mechanism being coupled to an exterior surface of said sheath proximate the top portion of said pocket, said securing mechanism including an elastomeric member forming a loop, said elastomeric member being attached to said sheath at a first attachment point proximate a first side of said sheath and at a second attachment point proximate a second side of said sheath, said elastomeric member being stretchable from a neutral, at rest, position where said elastomeric member is positioned and located below the top portion of said pocket to a secured position engaging at least a portion of a drill located within said pocket, said secured position having a perimeter greater than the perimeter of said elastomeric member when in its neutral position, and said securing mechanism including a cord lock engageable with said elastomeric member for adjustably defining the perimeter of said loop.

2. The drill holster of claim 1 wherein said cord lock is spring-loaded.

3. The drill holster according to claim 1 wherein said elastomeric member is free to slide within at least one of said first and second attachment points.

4. The drill holster according to claim 1 including a reinforcing member disposed on an exterior surface of said base member, said reinforcing member extending at least adjacent to the bottom portion of said pocket.

5. The drill holster according to claim 1 including a gripping member slidably attached to said elastomeric member.

6. The drill holster according to claim 1 including at least one loop attached to the exterior surface of said sheath for holding accessories.

7. The drill holster according to claim 1 including at least one pocket attached to the exterior surface of said sheath for holding accessories.

8. A drill holster comprising:

a base member having a reinforcing layer disposed on an exterior surface thereof;

a sheath coupled to said base member to define a pocket between said base member and said sheath for receiving a drill therewithin said pocket having an open top, an open bottom, a first side, a second side, and an exterior surface, said reinforcing layer being disposed adjacent to said open bottom; and a securing mechanism for retaining a drill in said pocket, said securing mechanism including an elastomeric member forming, a securing loop, said securing loop being attached to the exterior surface of said sheath proximate the open top of said pocket at a first attachment point proximate a first side of said pocket, at a second attachment point proximate a second side of said pocket, and at a third attachment point located between said first and second sides of said pocket, said securing loop being free to slide relative to at least two of said first, second and third attachment points, said securing loop being positioned and located below the open top of said pocket when in its neutral unstretched position, and being stretchable to a secured position around a drill positioned within said pocket, the perimeter of said securing loop when in its stretched secured position being greater than the perimeter of said securing loop when in its neutral position.

9. The drill holster according to claim 8 including a spring-loaded cord lock engageable with said securing loop for adjustably defining the perimeter of said securing loop.

10. The drill holster according to claim 8 including a gripping member slidably attachable to said securing loop.

11. The drill holster according to claim 8 including at least one loop attached to the exterior surface of said sheath for holding accessories.

12. The drill holster according to claim 8 including at least one pocket attached to the exterior surface of said sheath for holding accessories.

13. The drill holster according to claim 8 including an attachment system for attaching to a garment, said attachment system including a foldable flap coupled to said base member and being positionable in a downward position, a first wing member coupled to a first side of said base member, said first wing member overlapping said foldable flap when in its downward position in a first closed position, and a second wing member coupled to a second side of said base member, said second wing member overlapping said first wing member in a second closed position.

14. A drill holster comprising:

a base member;

a sheath coupled to said base member defining a pocket between said base member and said sheath for receiving a drill within said pocket, said pocket having an open top portion and a bottom portion;

an elastomeric member forming a loop, said elastomeric member being attached to the exterior surface of said sheath proximate the open top portion of said pocket, said loop being positioned and located below the open top portion of said pocket when in its neutral, at-rest position, and said loop being stretchable to a secured position around a drill positioned within said pocket, the perimeter of said loop when in its stretched secured position being greater than the perimeter of said loop when in its neutral, at-rest position;

a foldable flap coupled to said base member, said foldable flap having at least a downward position and being engageable with a loop associated with a garment to which the drill holster is to be attached;

a first wing member coupled to a first side of said base member, said first wing member overlapping said foldable flap in its downward position when in a first closed position; and a second wing member coupled to a second side of said base member, said second wing member overlapping said first wing member when in a second closed position; wherein said foldable flap includes a first securing mechanism disposed thereon when in its downward position, said first wing member includes a second securing mechanism disposed on one side thereof and a third securing mechanism disposed on its opposite side, and said second wing member includes a fourth securing mechanism disposed on one side thereof, wherein said first securing mechanism matingly engages said second securing mechanism, and said third securing mechanism matingly engages said fourth securing mechanism.

15. The drill holster according to claim 14 wherein the first and fourth securing mechanisms are a loop portion of a hook and loop fastener, and said second and third securing mechanisms are a hook portion of a hook and loop fastener.

* * * * *